US007868869B2

(12) United States Patent
Shin et al.

(10) Patent No.: US 7,868,869 B2
(45) Date of Patent: Jan. 11, 2011

(54) ELECTROPHORESIS DISPLAY AND DRIVING METHOD THEREOF

(75) Inventors: Sung Woo Shin, Seoul (KR); Jeong Uk Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 827 days.

(21) Appl. No.: 11/819,136

(22) Filed: Jun. 25, 2007

(65) Prior Publication Data

US 2008/0143668 A1 Jun. 19, 2008

(30) Foreign Application Priority Data

Dec. 13, 2006 (KR) ..... 10-2006-0127342

(51) Int. Cl.
*G09G 3/34* (2006.01)

(52) U.S. Cl. ..... 345/107; 345/209; 359/296

(58) Field of Classification Search ..... 345/107, 345/204, 690, 208–210; 359/296
See application file for complete search history.

(56) References Cited

U.S. PATENT DOCUMENTS 7,528,822 B2 * 5/2009 Amundson et al. ..... 345/107
2002/0005832 A1 * 1/2002 Katase ..... 345/107
2004/0119680 A1 6/2004 Daniel et al.
2004/0125066 A1 7/2004 Park et al.
2006/0209011 A1 * 9/2006 Miyasaka ..... 345/107

* cited by examiner

*Primary Examiner*—Stephen G Sherman
(74) *Attorney, Agent, or Firm*—McKenna Long & Aldridge

(57) ABSTRACT

An electrophoresis display for decreasing a drive voltage, and a driving method thereof are disclosed.

In the electrophoresis display, an electrophoresis display panel has a plurality of data lines and a plurality of gate lines which are crossed each other, and a plurality of cells which are driven in accordance with a voltage applied to a pixel electrode and a common electrode. A data driving circuit converts a digital data into a data voltage to supply it to the data lines. A gate driving circuit supplies a scan pulse to the gate lines. A common voltage generation circuit supplies an AC common voltage that a polarity is inversed by one frame period for at least several frame periods, to the common electrode. And a timing controller controls of the data driving circuit, the gate driving circuit and the common voltage generation circuit, and supplies the digital data to the data driving circuit.

20 Claims, 10 Drawing Sheets

ELECTROPHORESIS DISPLAY AND DRIVING METHOD THEREOF

This application claims the benefit of Korean Patent Application No. P2006-127342 filed in Korea on Dec. 13, 2006, which is hereby incorporated by reference.

BACKGROUND OF THE INVENTION

1. Field of the Invention

The present invention relates to an electrophoresis display, and more particularly to an electrophoresis display that is adaptive for decreasing a drive voltage, and a driving method thereof.

2. Description of the Related Art

If a material having electric charge is placed in DC electric field, the material peculiarly moves in accordance with electric charges, the size and shape of molecules and the like. Such a movement is named 'Electrophoresis'. Recently, a display using electrophoresis has been developed and attention has been paid thereto as a medium with which a conventional paper medium could be replaced.

The display using electrophoresis has been disclosed in U.S. Pat. Nos. 7,012,600 and 7,119,772. The electrophoresis display of the related art compares current state images with next state images for each cell by use of a look-up table (LUT) 1, a plurality of memories 2 to 4 and a frame counter 5, as shown in FIG. 1, thereby determining the data V1 to Vn which are to be supplied to each cell for a plurality of frame periods, as a result.

The data V1 to Vn outputted from the look-up table 1 are digital data such as '00', '01', '10' and '11', and are changed to voltages of three states which are applied to a pixel electrode of each cell, that is, Ve+, Ve−, and Ve0. '00' and '11' in the digital data is changed to 0V, '01' is changed to Ve+(+15V), and '10' is changed to Ve−(−15V).

FIG. 2 shows an example of a drive waveform which is supplied for a plurality of frame periods in accordance with a data written in the current state and a data to be written in the next state. In FIG. 2, 'W(11)' represents a white gray level, 'LG(10)' represents a bright gray level, 'DG(01)' represents a dark gray level, and 'B(00)' represents a black gray level. And, the number written under the drive waveform is the number of frames.

A DC common voltage Vcom is supplied to a common electrode which is opposite to a pixel electrode. A positive data voltage Ve+ supplied to the pixel electrode is a voltage which is higher than the DC common voltage Vcom, and a negative data voltage Ve− is a voltage which is lower than the DC common voltage Vcom.

A method of driving the electrophoresis display has problems: firstly, the storage capacity of a memory 4 becomes that much larger because the digital data of each cell is 2 bits; secondly, since a reset voltage waveform, a stable voltage waveform, and an entry data voltage waveform are sequentially supplied to a pixel electrode for the plurality of frame periods so as to allow all cells to be uniformed to a bistable state after initializing the previous cell state. Thus, time which is required at a data update, is increased. On the other hand, a data voltage can be boosted so as to decrease time which is spent at the data update. However, elements within a data drive integrated circuit (D-IC) should be configured as high voltage elements because of a high data voltage, thus the size of the D-IC should be that much larger and the cost thereof is increased.

SUMMARY OF THE INVENTION

Accordingly, it is an object of the present invention to provide an electrophoresis display that is adaptive for decreasing a drive voltage, and a driving method thereof.

In order to achieve these and other objects of the invention, an electrophoresis display according to the present invention comprises a electrophoresis display panel having a plurality of data lines and a plurality of gate lines which are crossed each other, and a plurality of cells which are driven in accordance with a voltage applied to a pixel electrode and a common electrode; a data driving circuit converting a digital data into a data voltage to supply the data voltage to the data lines; a gate driving circuit supplying a scan pulse to the gate lines; a common voltage generation circuit supplying an AC common voltage that a polarity is inversed by one frame period for at least several frame periods, to the common electrode; and a timing controller controlling of the data driving circuit, the gate driving circuit and the common voltage generation circuit, and supplying the digital data to the data driving circuit.

Each of the cells includes a micro capsule having a positively charged white particle and a negatively charged black particle which can be driven in accordance with a voltage with which the pixel electrode and the common electrode supplied.

The timing controller includes a memory storing a current frame image and a next frame image; and a look-up table comparing the current frame image with the next frame image by the unit of the cell, outputting the digital data of one bit and a common voltage control data of one bit that controls the drive waveform of the predetermined AC drive voltage.

The drive waveform of the data voltage includes a reset voltage waveform which is generated for a reset period inclusive of a plurality of frame periods to initialize the micro capsule; a first stabilization voltage waveform for separating the electrically charged particles within the micro capsule for a first stabilization period inclusive of a plurality of frame periods, following the reset period; a second stabilization voltage waveform for separating the electrically charged particles within the micro capsule in a direction opposite to the first stabilization period for a second stabilization period inclusive of a plurality of frame periods, following the first stabilization period; and an entry data voltage waveform for expressing a gray level in the cell for a data writing period inclusive of a plurality of frame periods, following the second stabilization period.

A polarity of the AC common voltage is inversed by the one frame period unit for the reset period, the first stabilization period, the second stabilization period, and the data writing period.

The entry data voltage waveform is generated in the same phase as a phase of the. AC common voltage at a portion of the data writing period.

A polarity of the AC common voltage is inversed by the one frame period unit for the reset period and the data writing period, and the AC common voltage is maintained as a high potential voltage for the first stabilization period and is maintained as a low potential voltage for the second stabilization period.

The entry data voltage waveform is maintained as a low potential voltage for the first stabilization period, and is maintained as a high potential voltage for the second stabilization period.

In the electrophoresis display, each of the cells includes a micro capsule having a negatively charged white particle and a positively charged black particle which can be driven in accordance with a voltage with which the pixel electrode and the common electrode supplied.

A method of driving an electrophoresis display according to an aspect of the present invention comprises converting a digital data into a data voltage to supply it to the data line; supplying a scanning pulse to the gate line; and supplying an AC common voltage that a polarity is inversed by one frame period for at least several frame periods, to the common electrode.

A method of driving an electrophoresis display according to another aspect of the present invention comprises supplying a data voltage to the pixel electrode and supplying a common voltage having a potential difference between the common electrode and the data voltage, to the common electrode to change an arranged state of charged particles within the cells; and supplying a data voltage that a voltage is periodically changed, to the pixel electrode and a common voltage that a voltage is changed in a waveform having the same phase as a waveform of the data voltage, to the common electrode to maintain an arranged state of the charged particles within the cells.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Hereinafter, the preferred embodiments of the present invention will be described in detail with reference to FIG. 3 to FIG. 10.

Figure 1:
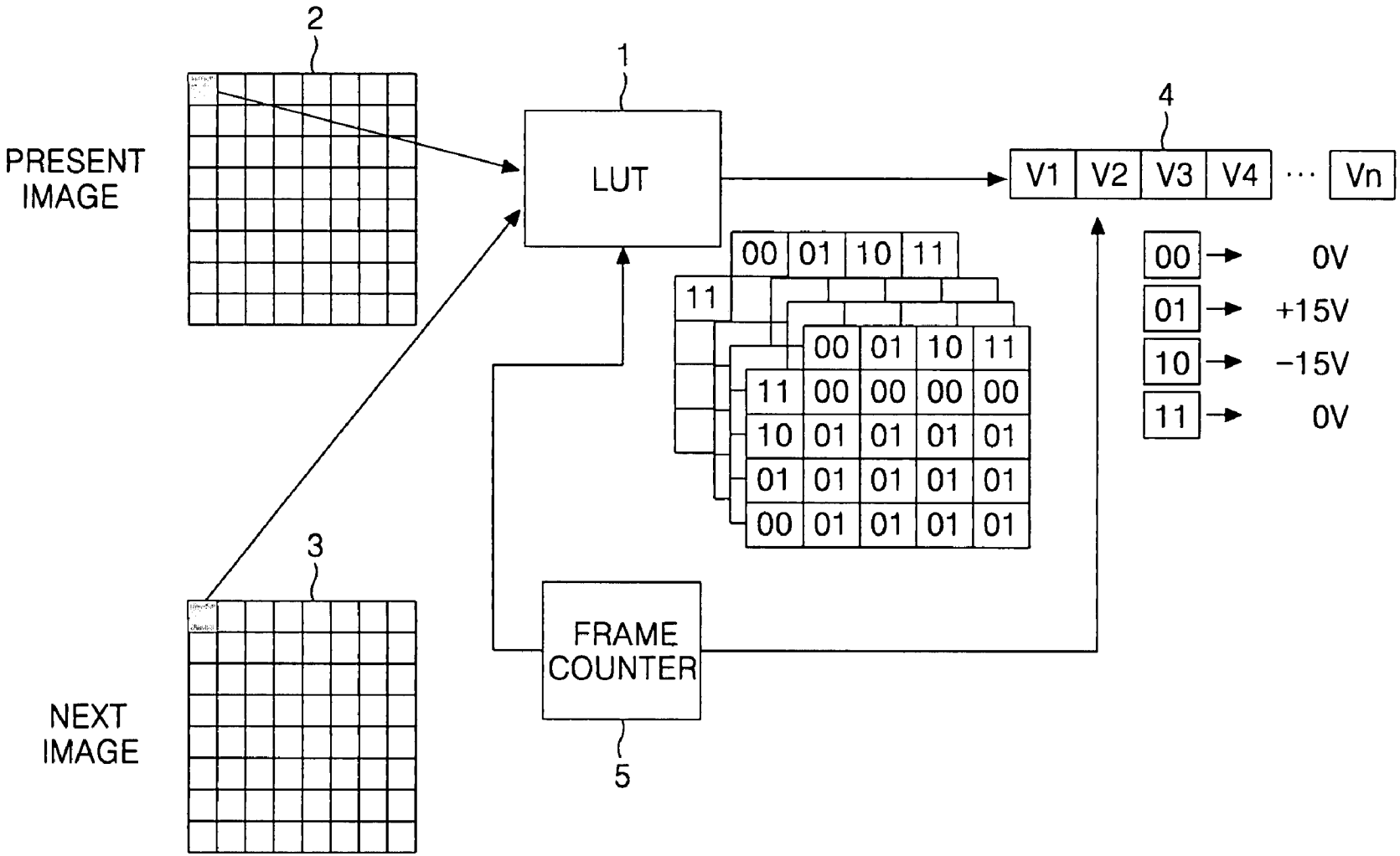
FIG. 1 RELATED ART
FIG. 1 is a diagram showing a circuit for generating a data voltage waveform in an electrophoresis display of the related art.
Figure 2:
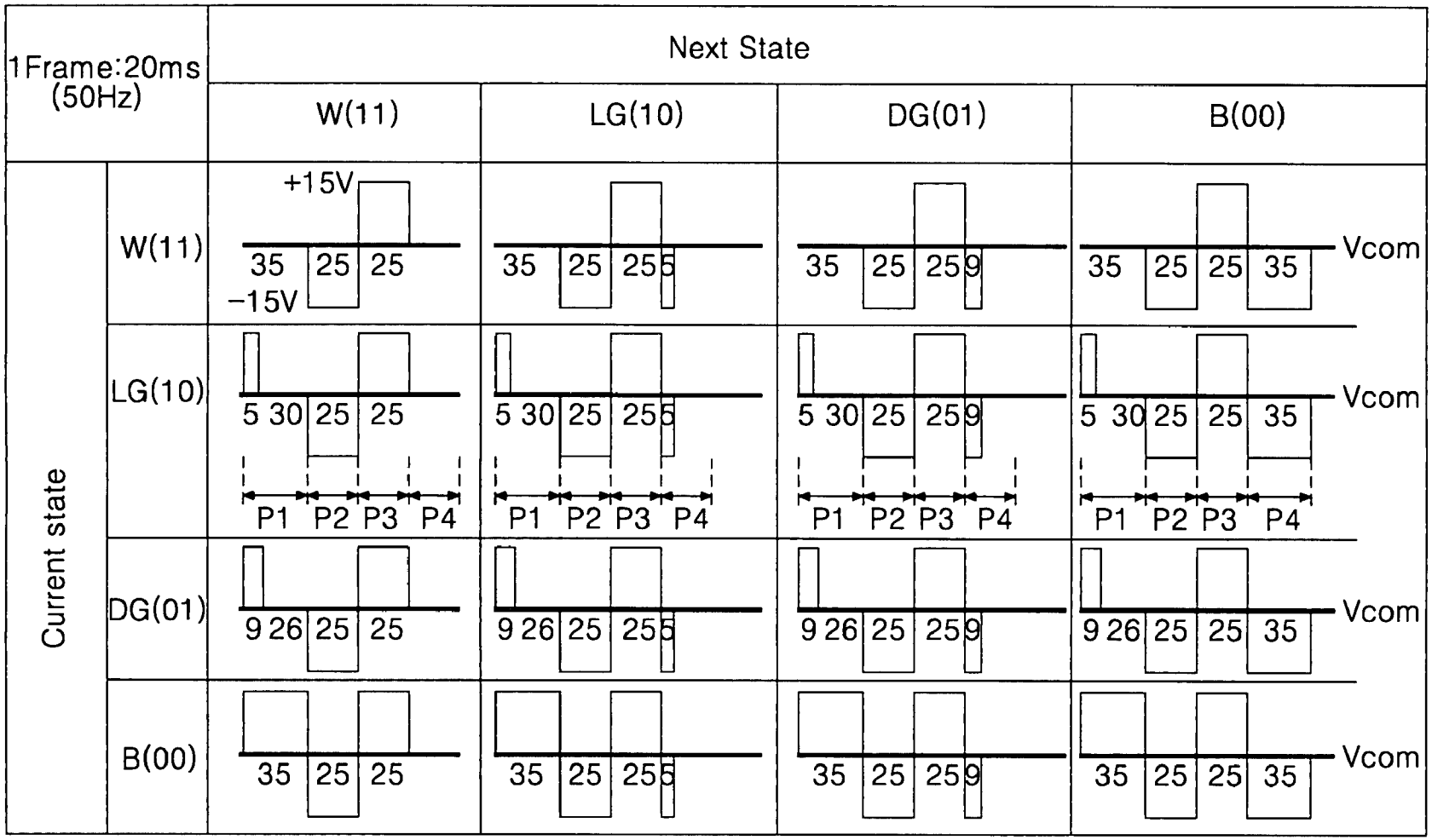
FIG. 2 RELATED ART
FIG. 2 is a diagram showing an example of a data voltage waveform registered in a look-up table shown in FIG. 1.
Figure 3:
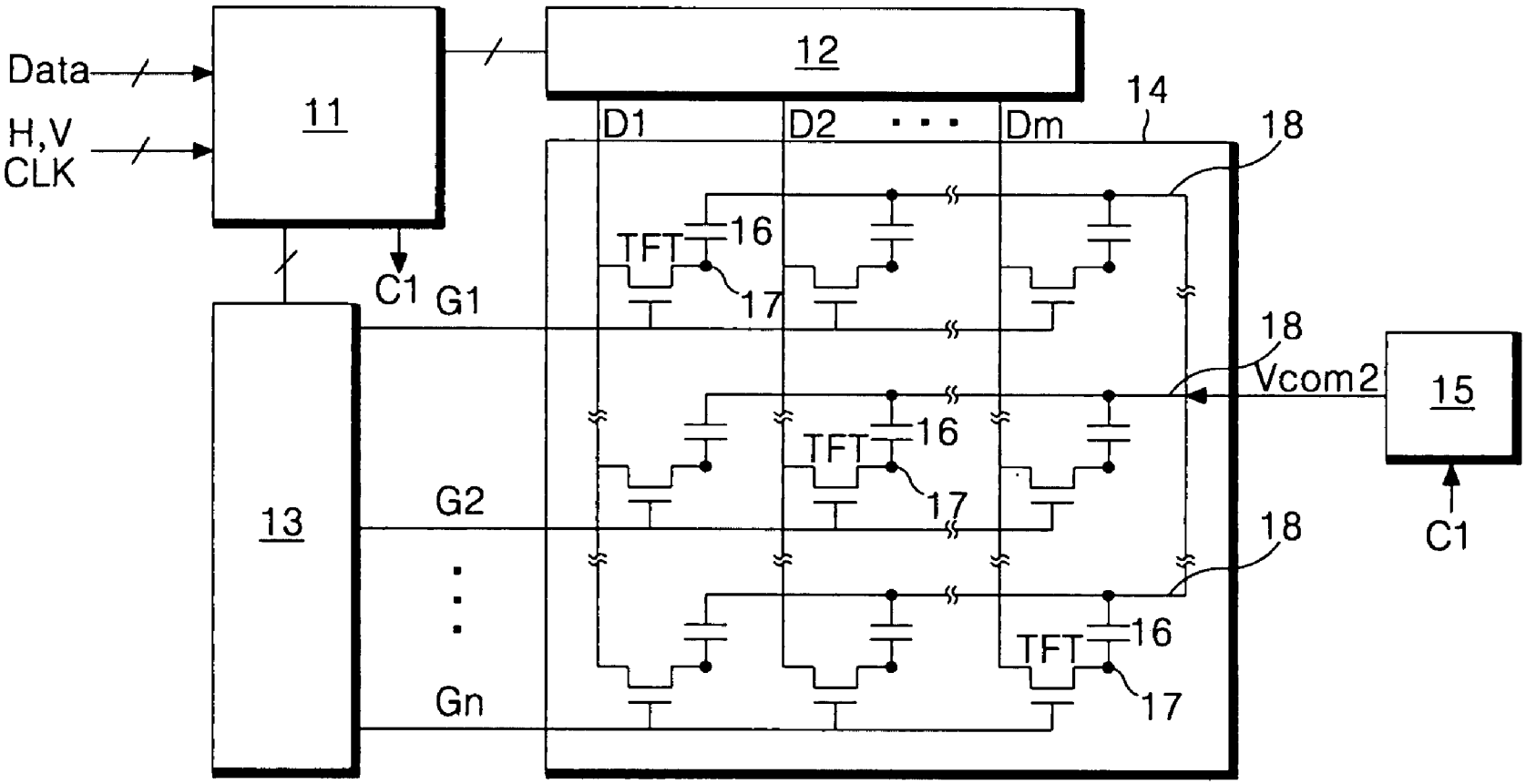
FIG. 3 is a block diagram showing an electrophoresis display according to an embodiment of the present invention.
Figure 4:
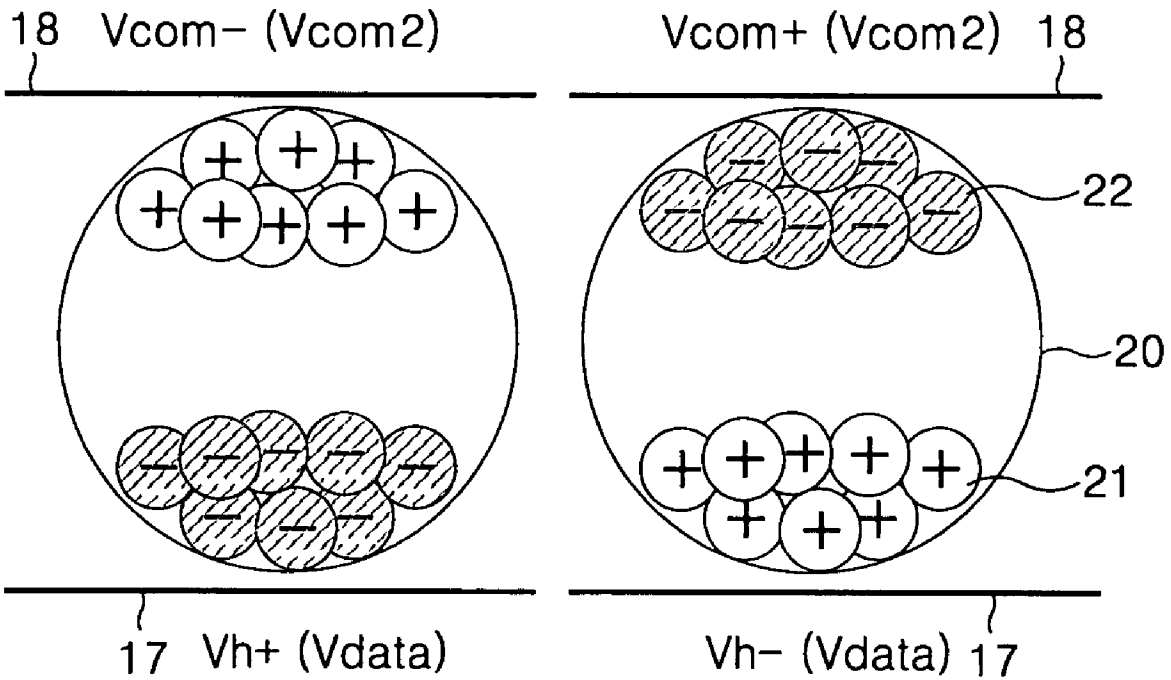
FIG. 4 is a diagram showing in detail a micro capsule structure of a cell shown in FIG. 3.

FIG. 3 and FIG. 4 show an electrophoresis display and a cell according to an embodiment of the present invention.

Referring to FIG. 3 and FIG. 4, the electrophoresis display according to the embodiment of the present invention includes a display panel 14 where m ×n number of cells 16 are arranged; a data driving circuit 12 for supplying data voltages to data lines D1 to Dm of the display panel 14; a gate driving circuit 13 for supplying scan pulses to gate lines G1 to Gn of the display panel 14; a common voltage generation circuit 15 for supplying AC common voltages Vcom2 that a potential and a polarity are inversed by one frame period, to a common electrode 18 of the display panel 14; and a timing controller 11 for controlling the data gate driving circuits 12, 13 and the common voltage generation circuit 15.

The display panel 14 has a plurality of micro capsules 20 interposed between two substrates, as in FIG. 4. Each of the micro capsules 20 includes white particles 21 which are electrically charged to be positive and black particles 22 which are electrically charged to be negative. The m number of data lines D1 to Dm and the n number of gate lines G1 to Gn which are formed on a lower substrate of the display panel 14 are made to cross each other. Thin film transistors (hereinafter, referred to as "TFT") are connected in intersections of the data lines D1 to Dm and the gate lines G1 to Gn. A source electrode of the TFT is connected to the data line D1 to Dm and a drain electrode thereof is connected to a pixel electrode 17. And, a gate electrode of the TFT is connected to the gate line G1 to Gn. The TFT is turned on in response to a scan pulse from the gate line G1 to Gn, thereby selecting cells 16 of one line which are intended to be displayed. A common electrode 18 is formed on an upper transparent substrate of the display panel 14 for simultaneously supplying the AC common voltage Vcom2 to all the cells. Herein, the common electrode 18 is formed of a transparent conductive material such as Indium Tin Oxide (ITO), etc.

On the other hand, the micro capsules 20 might include the negatively charged white particles and the positively charged black particles. In this case, the phase and voltage of the later-described drive waveform might be changed.

The data driving circuit 12 has a plurality of data drive integrated circuits of which each includes a shift register, a latch, a digital-analog converter, an output buffer and etc. The data driving circuit 12 latches the digital data under control of the timing controller 11, converts the digital data into a gamma compensation voltage to generate the data voltage, and then supplies the data voltage to the data lines D1 to Dm.

The gate driving circuit 13 has a plurality of gate drive integrated circuits of which each includes a shift register, a level shifter for converting a swing width of an output signal of the shift register into a swing width which is suitable for driving the TFT, and an output buffer being connected between the level shifter and the gate line G1 to Gn. The gate driving circuit 13 sequentially outputs the scan pulses synchronized with the data voltages supplied to the data lines D1 to Dm.

The timing controller 11 receives vertical/horizontal synchronization signals V, H and a clock signal CLK, and generates control data controlling operation timings of the data and gate driving circuits 12, 13 and a control data controlling an operation timing of the common voltage generation circuit 15. Further, the timing controller 11 generates the digital data corresponding to the drive waveform of the data voltage by use of a frame counter which counts the number of frames and a look-up table which compares an image of the previous frame stored at a memory with an image of the current frame and determines drive waveforms of the AC common voltage Vcom2 and the data voltage in accordance with the comparison result, and supplies the digital data to the data driving circuit 12.

The common voltage generation circuit 15 generates the AC common voltage Vcom2 that a potential and a polarity are inversed by one frame period, between a high potential common voltage Vcom+ and a low potential common voltage Vcom− in response to the control data C1 from the timing controller 11, and supplies the AC common voltage Vcom2 to the common electrode 18. A Kick back voltage generated by a parasitic capacitance of the TFT is changed in accordance with a polarity of a data voltage regarding the AC common voltage Vcom2. Thus, in order to compensate the Kick back voltage, the high potential common voltage Vcom+ and the low potential common voltage Vcom− are independently adjusted in the common voltage generation circuit 15.

Figure 5:
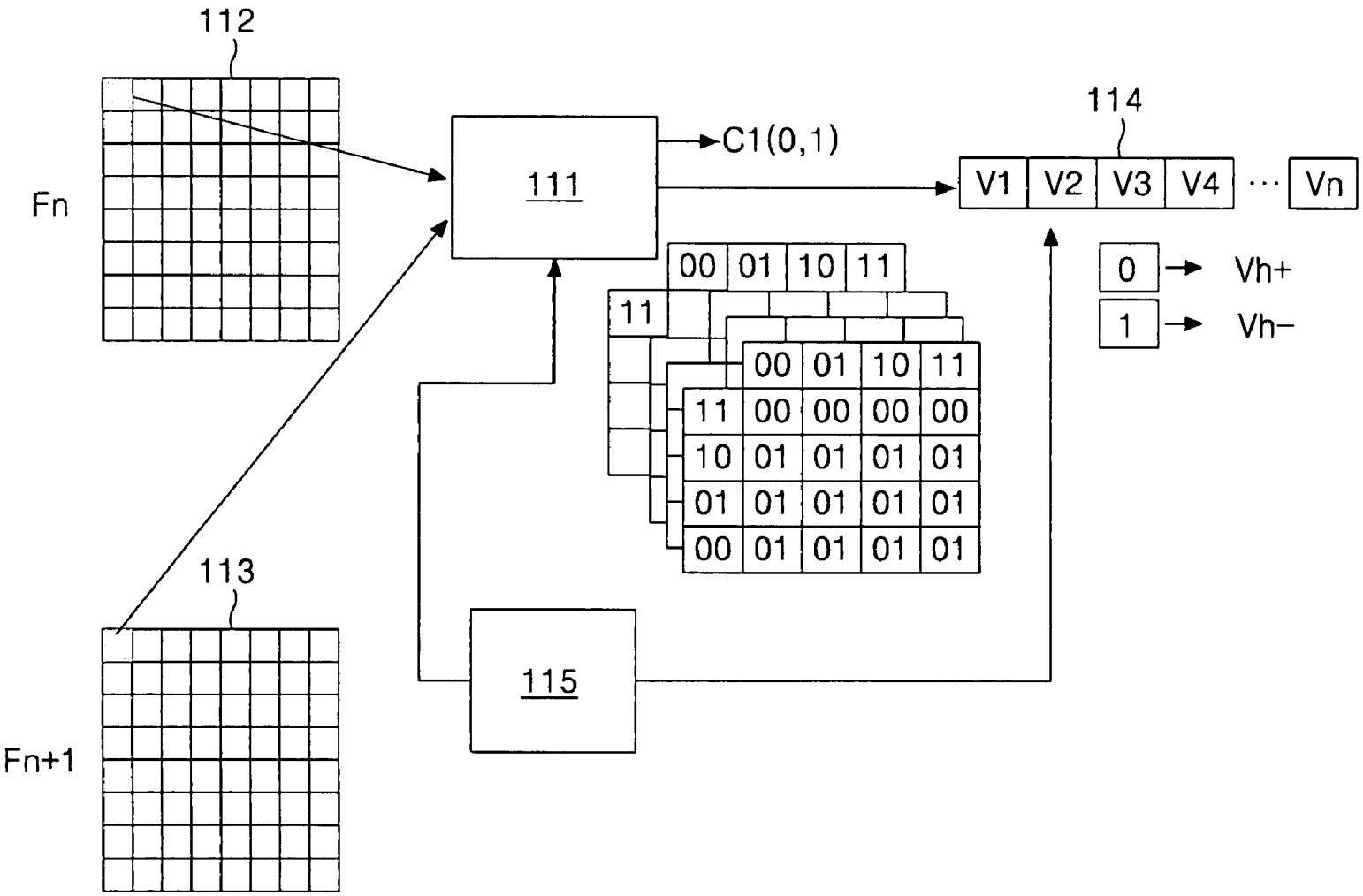
FIG. 5 is a circuit diagram showing in detail a circuit which generates a control data of an AC common voltage and a digital data in a timing controller shown in FIG. 3.

FIG. 5 in detail represents a circuit which generates a control data of an AC common voltage and a digital data in a timing controller 11.

Referring to FIG. 5, the timing controller 11 includes a first frame memory 112 at which an image of the current frame Fn is stored; a second frame memory 113 at which an image of the next frame Fn+1 is stored; a look-up table 111 connected to the frame memories 112, 113; a frame counter 115 which counts the number of frames; and a data memory 114 which stores the digital data outputted from the look-up table 111. The data memory 114 may be a latch included in the integrated circuit IC of the later-described data driving circuit 12.

The look-up table 111 has a plurality of look-up tables which register a pulse width modulating data PWM on the drive waveform of the AC common voltage Vcom and the drive waveform of the data voltage supplied to each cell for a plurality of frame period in accordance with the image of the current frame Fn and the image of the next frame Fn+1 for each frame. The look-up table 111 compares the image of the current frame Fn with the image of the next frame by the unit of a cell for each frame in accordance with the frame number information from the frame counter 115, and selects the digital data of one bit for each cell in accordance with the comparison result. The digital data of each cell selected from the look-up table 111 includes a reset data erasing a current image in all cells to initialize all cells, a stabilization data stabilizing all cells to the bistable state, and an entry data expressing a gray scale of a next image. Further, the look-up table 111 selects the control data C1 of one bit indicating the drive waveform of the predetermined AC common voltage Vcom2, and supplies the control data C1 to the common voltage generation circuit 15.

Figure 6:
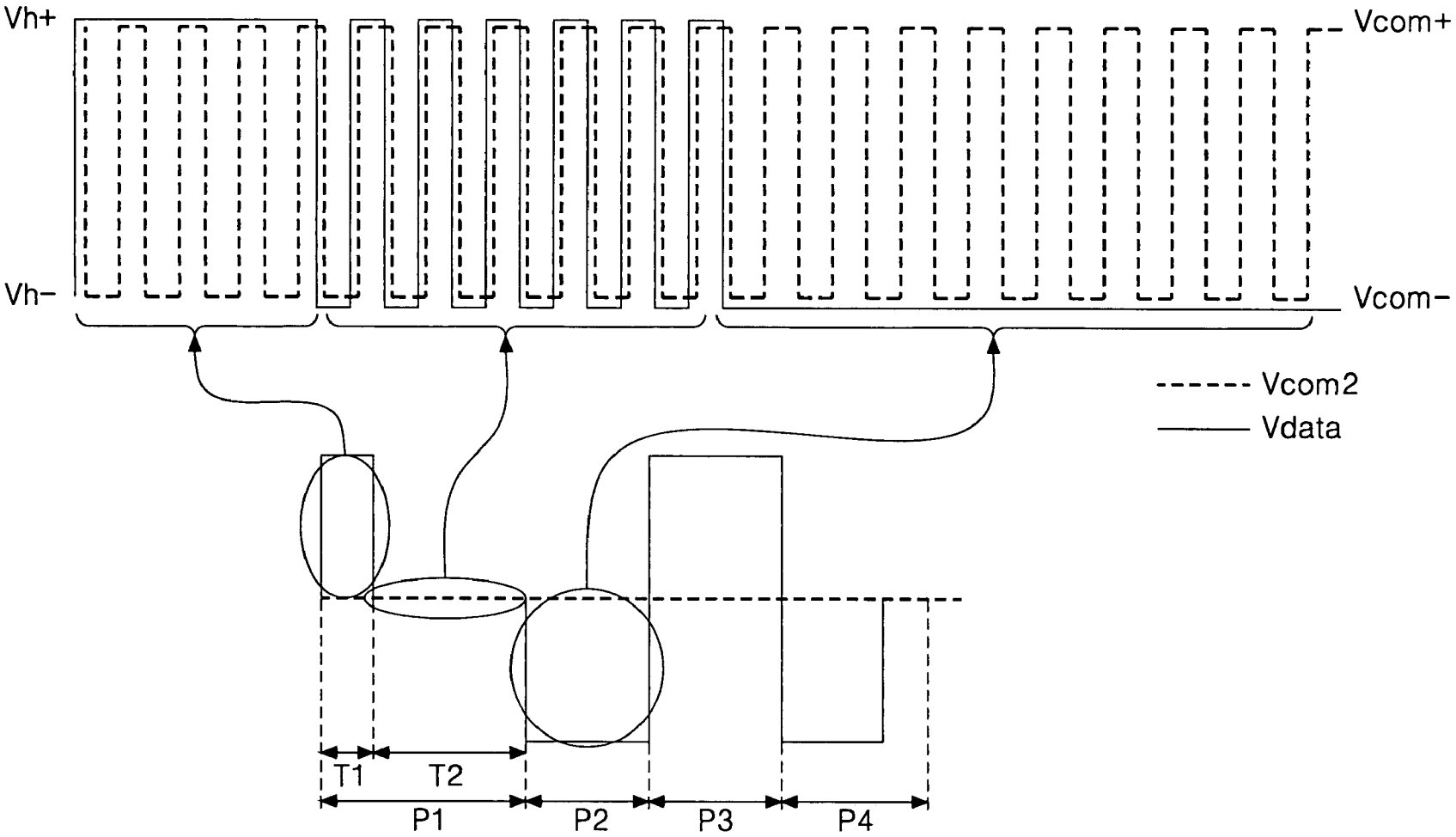
FIG. 6 is a waveform diagram showing waveforms of a data voltage and an AC common voltage according to a first embodiment of the present invention.
Figure 7:
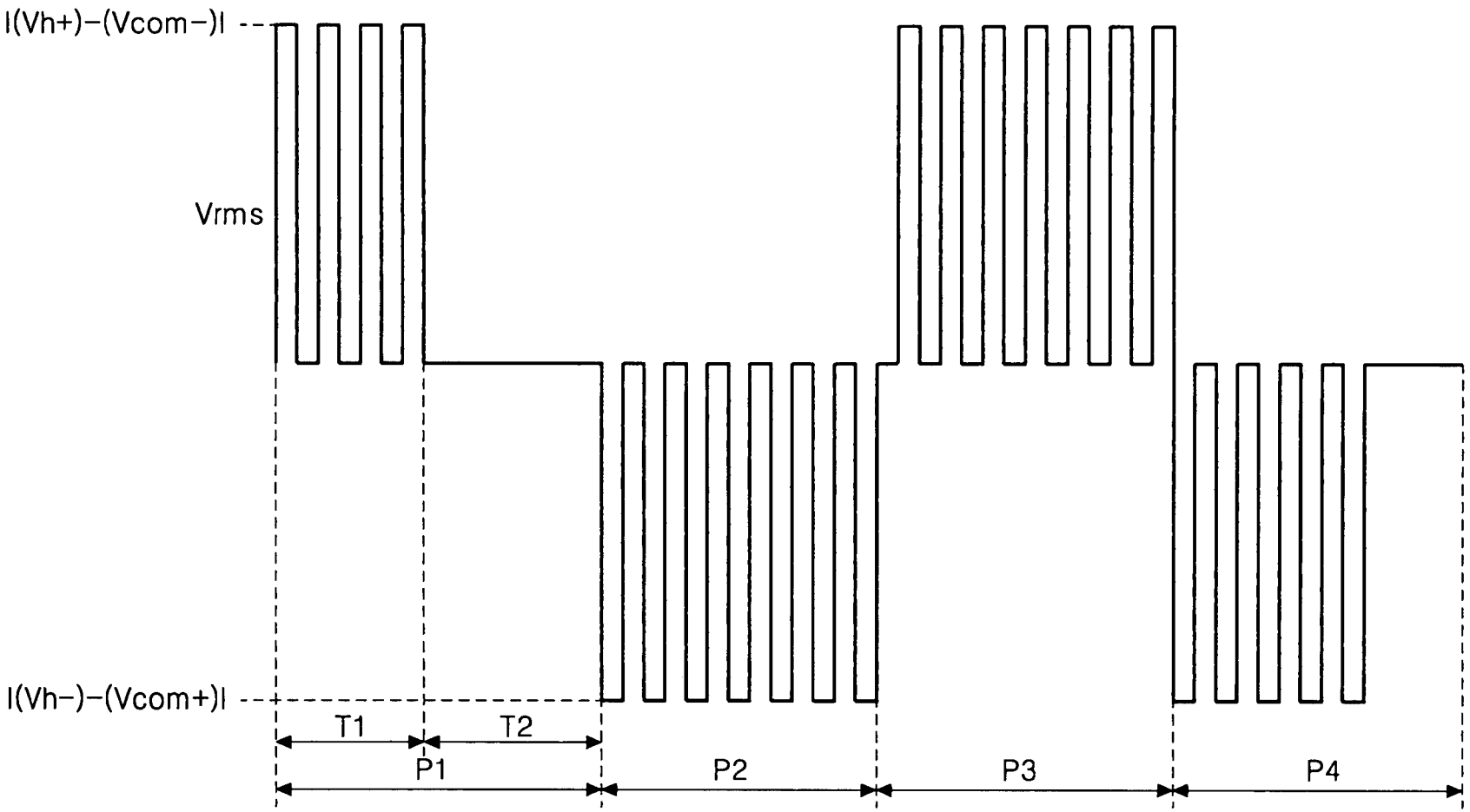
FIG. 7 is a waveform diagram showing a waveform of an effective voltage according to the first embodiment of the present invention.

FIG. 6 and FIG. 7 show an example of a data voltage Vdata, an AC common voltage Vcom2, and an effective voltage Vrms according to a first embodiment of the present invention. In FIG. 6, a solid line represents a data voltage Vdata swinging between a Vh+ potential and a Vh− potential, and a dotted line represents an AC common voltage Vcom2 swinging between the Vh+ potential and the Vh− potential.

Referring to FIG. 6 and FIG. 7, the micro capsule 20 is divided into a reset period P1, a first stabilization period P2, a second stabilization period P3, and a data writing period P4 in accordance with the data voltage Vdata with which the pixel electrode 17 is supplied and the AC common voltage Vcom2 with which the common electrode 18 is supplied, to be driven with time-divide method.

If a potential difference is not generated between the data voltage Vdata and the AC common voltage Vcom2, an arranged state of a positively charged white particle 21 and a negatively charged black particle 22 is maintained within the micro capsule 20. If a potential difference is generated between the data voltage Vdata and the AC common voltage Vcom2, an arranged state of the positively charged white particle 21 and the negatively charged black particle 22 is changed within the micro capsule 20 as shown in FIG. 4.

The reset period P1 includes a first interval T1 and a second interval T2. Herein, the high potential data voltage Vh+ is supplied to the pixel electrode 17, and the AC common voltage Vcom2 that a potential and a polarity are inversed by one frame period, is supplied to the common electrode 18 for the first interval T1. An AC voltage having the same phase is supplied to the pixel electrode and the common electrode 18 for the second interval T2. The number of frame period to which the high potential data voltage Vh+ is supplied, is varied in accordance with a gray scale of a current image by each cell unit. The first interval T1 includes the more frame period as the gray scale of a current image becomes lower. If the first interval T1 is increased within the reset period P1, the second interval T2 is relatively decreased. On the other hand, if the first interval T1 is decreased within the reset period P1, the second interval T2 is relatively increased. Accordingly, the first interval T1 and the second interval T2 of the reset period P1 are varied in accordance with the gray scale of a current image in each cell.

Arrangements and separated degrees of the positively charged white particle 21 and the negatively charged black particle 22 are different from each other in accordance with the gray scale of a current image within the micro capsule 20 of each cell. Thus, the data driving circuit 12 supplies the high potential data voltage Vh+ to the data lines D1 to Dm, and the common voltage generation circuit 15 supplies the AC voltage Vcom2 that a potential and a polarity are inversed by one frame period, to the common electrode 18 for a plurality of frame periods included in the first interval T1 of the reset period P1 to primarily initialize a particle arrangement within the micro capsule 20 in all cells. Since waveforms of the AC voltages with which the pixel electrode 17 and the common electrode 18 are supplied, are the same phase in all cells for the second interval of the reset period P1, a potential difference is not generated between the data voltage Vdata and the AC common voltage Vdata.

For the first interval T1 of the reset period P1, a potential difference between the pixel electrode 17 and the common electrode 18 of the micro capsules 20 in all cells 16, that is, an effective voltage Vrms driving the micro capsules 20 is boosted to |(Vh+)−(Vcom−)|. Herein, |(Vh+)−(Vcom−)| corresponds to a sum of the AC common voltage Vcom and the data voltage Vcom. Since a potential difference is generated between the data voltage Vdata and the AC common voltage Vcom2 for an odd frame period within the first interval T1, and a potential difference is not generated between the data voltage Vdata and the AC common voltage Vcom2 for an even frame period within the first interval T1, the effective voltage is applied to the micro capsules 20 for a half period of whole frame periods included in the first interval T1, and 0V is supplied to the micro capsules 20 for another half period. In the related art electrophoresis display, an amplitude of the effective voltage driving the micro capsule 20 for the reset period P1 is about +15V determined in the data voltage. On the other hand, if each of the data voltage Vdata and the AC common voltage Vcom2 is swung between +15V and −15V for the reset period P1, respectively, the present invention can boost an amplitude of the effective voltage Vrms driving the micro capsule 20 to more than two times compared to the related art, that is, more than 30V. Accordingly, although an output of the data driving circuit 12 is the same as the related art, the present invention further boosts the effective voltage to speed up a particle movement within the micro capsule 20. As a result, the reset period P1 can be comprised of a frame period having a number less than a frame number which is required at the related art reset period P1.

For the first stabilization period P2, the data voltage Vdata is generated in the low potential data voltage Vh−. A potential and a polarity of the AC common voltage Vcom2 are inversed by one frame period for the first stabilization period P2. For the second stabilization period P3, the data voltage Vdata is generated in the high potential data voltage Vh+. A potential and a polarity of the AC common voltage Vcom2 are inversed by one frame period for the second stabilization period P3. For the first and second stabilization periods P2 and P3, the present invention alternatively inverses a polarity of the effective voltage Vrms to separate the positively charged white particle 21 from the negatively charged black particle 22 within the micro capsule 20 and to secondly initializes charged particles within the micro capsule 20 to the bistable state as shown in FIG. 7. Drive waveforms of the data voltage Vdata and the AC common voltage Vcom2 initializes all micro capsules 20 irrespective of a current image and a next image. Accordingly, the drive waveforms of the data voltage Vdata and the AC common voltage Vcom2 are the same each other for the first and second stabilization periods P2 and P3.

For the first stabilization period P2, a potential difference between the pixel electrode 17 and the common electrode 18 of the micro capsules 20 in all cells 16, that is, an effective voltage Vrms driving the micro capsules 20 is boosted to |(Vh−)−(Vcom+)|. Herein, |(Vh−)−(Vcom+)| corresponds to a sum of the AC common voltage Vcom and the data voltage Vcom. Since a potential difference is generated between the data voltage Vdata and the AC common voltage Vcom2 for an odd frame period within the first stabilization period P2, and a potential difference is not generated between the data voltage Vdata and the AC common voltage Vcom2 for an even frame period within the first stabilization period P2, the effective voltage is applied to the micro capsules 20 for a half period of whole frame periods included in the first stabilization period P2, and 0V is supplied to the micro capsules 20 for another half period. In the related art electrophoresis display, an amplitude of the effective voltage driving the micro capsule 20 for the first stabilization period P2 is about −15V determined in the data voltage. On the other hand, if each of the data voltage Vdata and the AC common voltage Vcom2 is swung between +15V and −15V for the first stabilization period P2, respectively, the present invention can boost an amplitude of the effective voltage Vrms driving the micro capsule 20 to more than two times compared to the related art, that is, more than 30V. Accordingly, although an output of the data driving circuit 12 is the same as the related art, the present invention further boosts the effective voltage to speed up a particle movement within the micro capsule 20. As a result, the first stabilization period P2 can be comprised of a frame period having a number less than a frame number which is required at the related art first stabilization period P2.

For the second stabilization period P3, a potential difference between the pixel electrode 17 and the common electrode 18 of the micro capsules 20 in all cells 16, that is, an effective voltage Vrms driving the micro capsules 20 is boosted to |(Vh+)−(Vcom−)|. Herein, |(Vh+)−(Vcom−)| corresponds to a sum of the AC common voltage Vcom and the data voltage Vcom. Since a potential difference is generated between the data voltage Vdata and the AC common voltage Vcom2 for an odd frame period within the second stabilization period P3, and a potential difference is not generated between the data voltage Vdata and the AC common voltage Vcom2 for an even frame period within the second stabilization period P3, the effective voltage is applied to the micro capsules 20 for a half period of whole frame periods included in the second stabilization period P3, and 0V is supplied to the micro capsules 20 for another half period. In the related art electrophoresis display, an amplitude of the effective voltage driving the micro capsule 20 for the second stabilization period P3 is about +15V determined in the data voltage. On the other hand, if each of the data voltage Vdata and the AC common voltage Vcom2 is swung between +15V and −15V for the second stabilization period P3, respectively, the present invention can boost an amplitude of the effective voltage Vrms driving the micro capsule 20 to more than two times compared to the related art, that is, more than 30V. Accordingly, although an output of the data driving circuit 12 is the same as the related art, the present invention further boosts the effective voltage to speed up a particle movement within the micro capsule 20. As a result, the second stabilization period P3 can be comprised of a frame period having a number less than a frame number which is required at the related art second stabilization period P3.

For the data writing period P4, the data voltage Vdata is generated in the low potential data voltage Vh−. A potential and a polarity of the AC common voltage Vcom2 are inversed by one frame period. The data writing period P4 are varied in accordance with a gray scale of a next image. For example, if a next image is the bright gray scale LG, the dark gray scale DG, or the black gray scale B, a frame period number of the data writing period P4 is increased as a gray scale is lower, that is, a gray scale goes to a black gray scale. A waveform of the data voltage Vdata can be generated in the same phase as a phase of the AC common voltage Vcom2 similar to the second interval T2 of the reset period P1 for another frame period other than frame periods writing data within the data writing period P4.

For the data writing period P4, the effective voltage Vrms driving particles of the micro capsules 20 in all cells 16, is boosted to |(Vh−)−(Vcom+)|. Herein, or |(Vh−)−(Vcom+)| corresponds to a sum of the AC common voltage Vcom and the data voltage Vcom. Since a potential difference is generated between the data voltage Vdata and the AC common voltage Vcom2 for an odd frame period within the data writing period P4, and a potential difference is not generated between the data voltage Vdata and the AC common voltage Vcom2 for an even frame period within the data writing period P4, the effective voltage is applied to the micro capsules 20 for a half period of whole frame periods included in the data writing period P4, and 0V is supplied to the micro capsules 20 for another half period. In the related art electrophoresis display, an amplitude of the effective voltage driving the micro capsule 20 for the data writing period P4 is about +15V or −15V determined in the data voltage. On the other hand, if each of the data voltage Vdata and the AC common voltage Vcom2 is swung between +15V and −15V for the data writing period P4, respectively, the present invention can boost an amplitude of the effective voltage Vrms driving the micro capsule 20 to more than two times compared to the related art, that is, more than 30V. Accordingly, although an output of the data driving circuit 12 is the same as the related art, the present invention further boosts the effective voltage to speed up a particle movement within the micro capsule 20. As a result, the data writing period P4 can be comprised of a frame period having a number less than a frame number which is required at the related art data writing period P4.

The present invention includes an initialization, a stabilization, and a data writing process for a plurality of frame period, that is, 128 frame periods to write one data by each cell unit.

Figure 8:
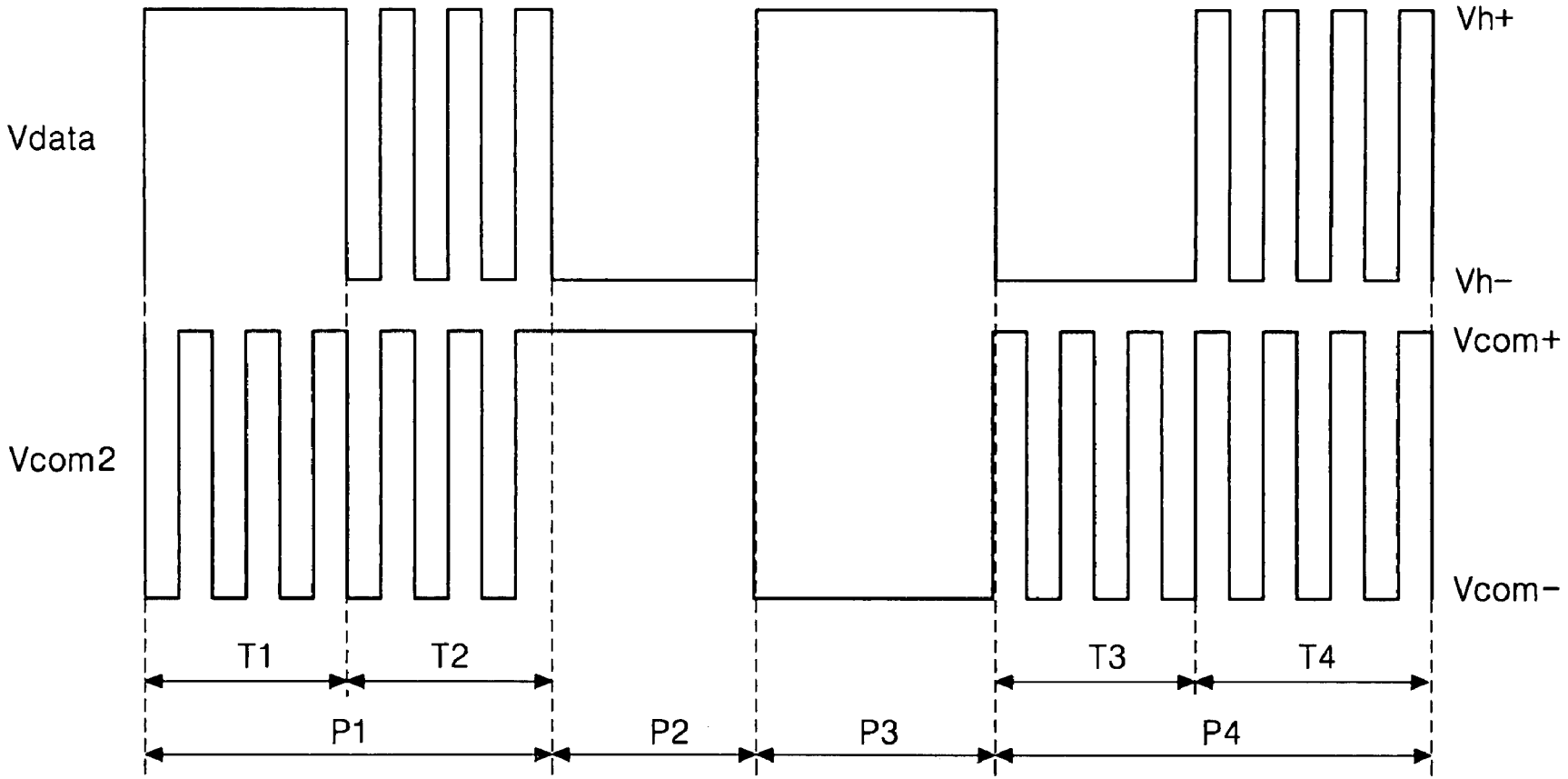
FIG. 8 is a waveform diagram showing waveforms of a data voltage and an AC common voltage according to a second embodiment of the present invention.
Figure 9:
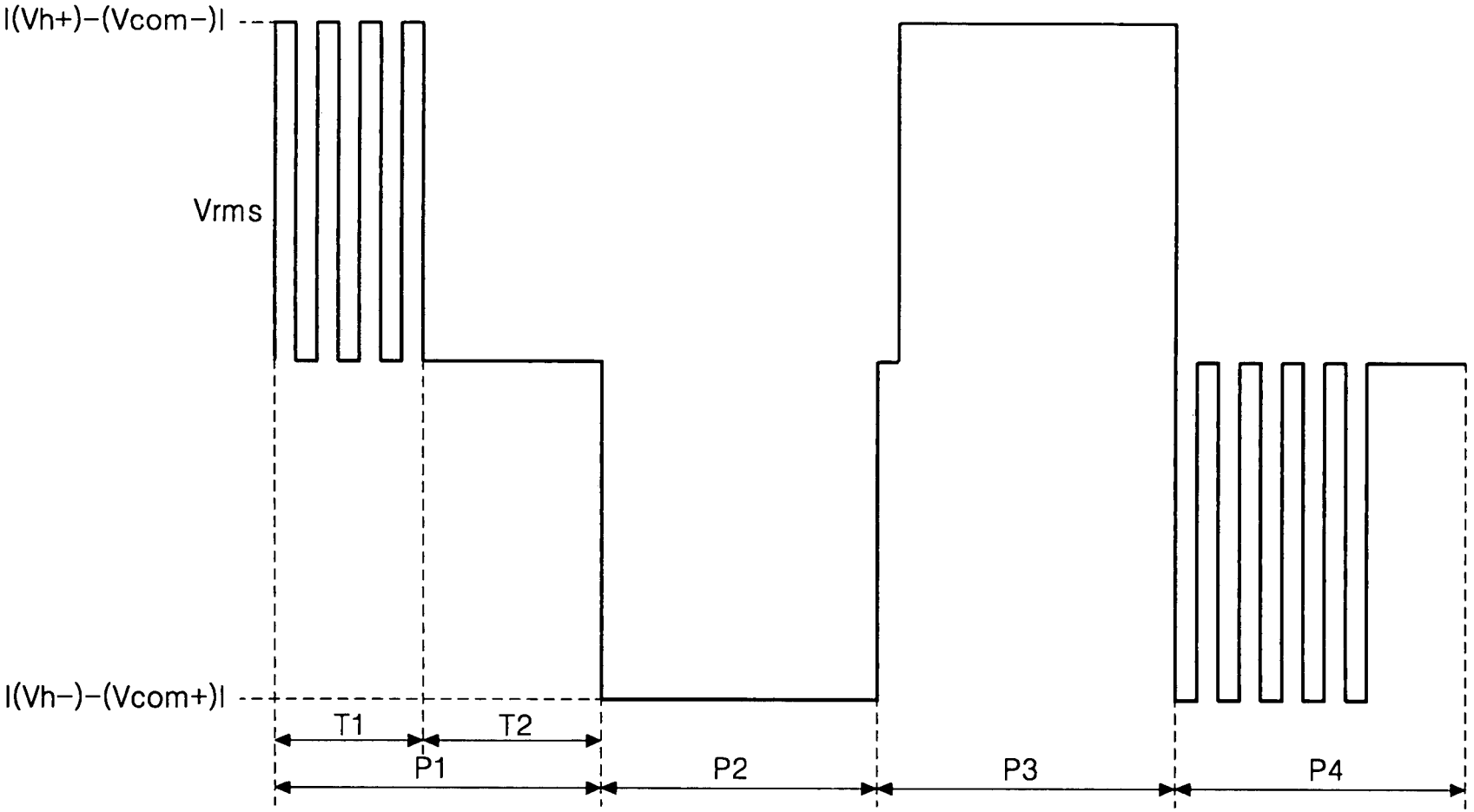
FIG. 9 is a waveform diagram showing a waveform of an effective voltage according to the second embodiment of the present invention.

FIG. 8 and FIG. 9 show an example of a data voltage Vdata, an AC common voltage Vcom2, and an effective voltage Vrms according to a second embodiment of the present invention.

Referring to FIG. 8 and FIG. 9, the micro capsule 20 is divided into a reset period P1, a first stabilization period P2, a second stabilization period P3, and a data writing period P4 in accordance with the data voltage Vdata with which the pixel electrode 17 is supplied and the AC common voltage Vcom2 with which the common electrode 18 is supplied, to be driven with time-divide method.

For the first interval T1 of the reset period P1, the data voltage Vdata is fixed at the high potential data voltage Vh+, and the AC common voltage Vcom2 is swung by one frame period. Accordingly, the effective voltage of |(Vh+)−(Vcom−)| is applied to all cells at an odd frame period for the first interval T1 of the reset period P1. A potential difference is hardly generated between the data voltage Vdata and the AC common voltage Vcom2 for an even frame period within the first interval T1 of the reset period P1. For the second interval T2 of the reset period P1, the data voltage Vdata is swung by one frame period between the high potential data voltage Vh+ and the low potential data voltage Vh−, and the AC common voltage Vcom2 is generated in the same phase as the waveform of the data voltage Vdata to swing by one frame period between the high potential data voltage Vh+ and the low potential data voltage Vh−.

For the first stabilization period P2, the data voltage Vdata is fixed at the low potential data voltage Vh−, and the AC common voltage Vcom2 is fixed at the high potential data voltage Vh+. On the other hand, for the second stabilization period P3, the data voltage Vdata is fixed at the high potential data voltage Vh+, and the AC common voltage Vcom2 is fixed at the low potential data voltage Vh−.

The data writing period P4 includes a third interval T3 and a fourth interval T4. Herein, a gray scale of a next image is determined for the third interval T3. The data voltage Vdata and the AC common voltage Vcom2 are generated in the same phase each other and a potential difference is not generated between the data voltage Vdata and the AC common voltage Vcom2 for the fourth interval T4. For the third interval T3 of the data writing period P4, the data voltage Vdata is fixed at the low potential data voltage Vh− in accordance with a gray scale of a next image, and a frame period number of the third interval T3 is changed. Herein, the data voltage Vdata is generated in accordance with a gray scale of a next image for the third interval T3. The AC common voltage Vcom2 is swung by one frame period between the high potential common voltage Vcom+ and the low potential common voltage Vcom− for the third interval T3 of the data writing period P4. The fourth interval T4 of the data writing period P4 is narrowed as the third interval T3 is widened within the data writing period P4, and the fourth interval T4 of the data writing period P4 is widened as the third interval T3 is narrowed within the data writing period P4. The data voltage Vdata and the AC common voltage Vcom2 are swung by one frame period for the fourth interval T4 of the data writing period P4. Waveforms of the data voltage Vdata and the AC common voltage Vcom2 are the same phase for the fourth interval T4 of the data writing period P4. Accordingly, a potential difference is not generated between the data voltage Vdata and the AC common voltage Vcom2 for the fourth interval T4 of the data writing period P4.

The second embodiment of the present invention fixes the data voltage Vdata for the first interval T1 of the reset period P1, the first and second stabilization periods P2 and P3, and the third interval T3 of the data writing period P4. The second embodiment of the present invention fixes the AC common voltage Vcom2 for the second and third stabilization periods P2 and P3.

The second embodiment of the present invention can boost the effective voltage Vrms driving the micro capsules 20 to more two times than the related art for the reset period P1, the first and second stabilization periods P2 and P3, and the data writing period P4 as shown in FIG. 9. Accordingly, although an output of the data driving circuit 12 is the same as the related art, the present invention further speeds up a particle movement within the micro capsule 20 to reduce a frame period number which is required at each reset period P1, first and second stabilization periods P2 and P3, and data writing period P4. Furthermore, since the second embodiment of the present invention fixes the data voltage Vdata for the first and second stabilization periods P2 and P3, the second embodiment of the present invention decreases the frequency of a polarity inversion of the AC common voltage Vcom2 compared to the first embodiment to reduce a current consumption and a generation of heat of the common voltage generation circuit 15.

Figure 10:
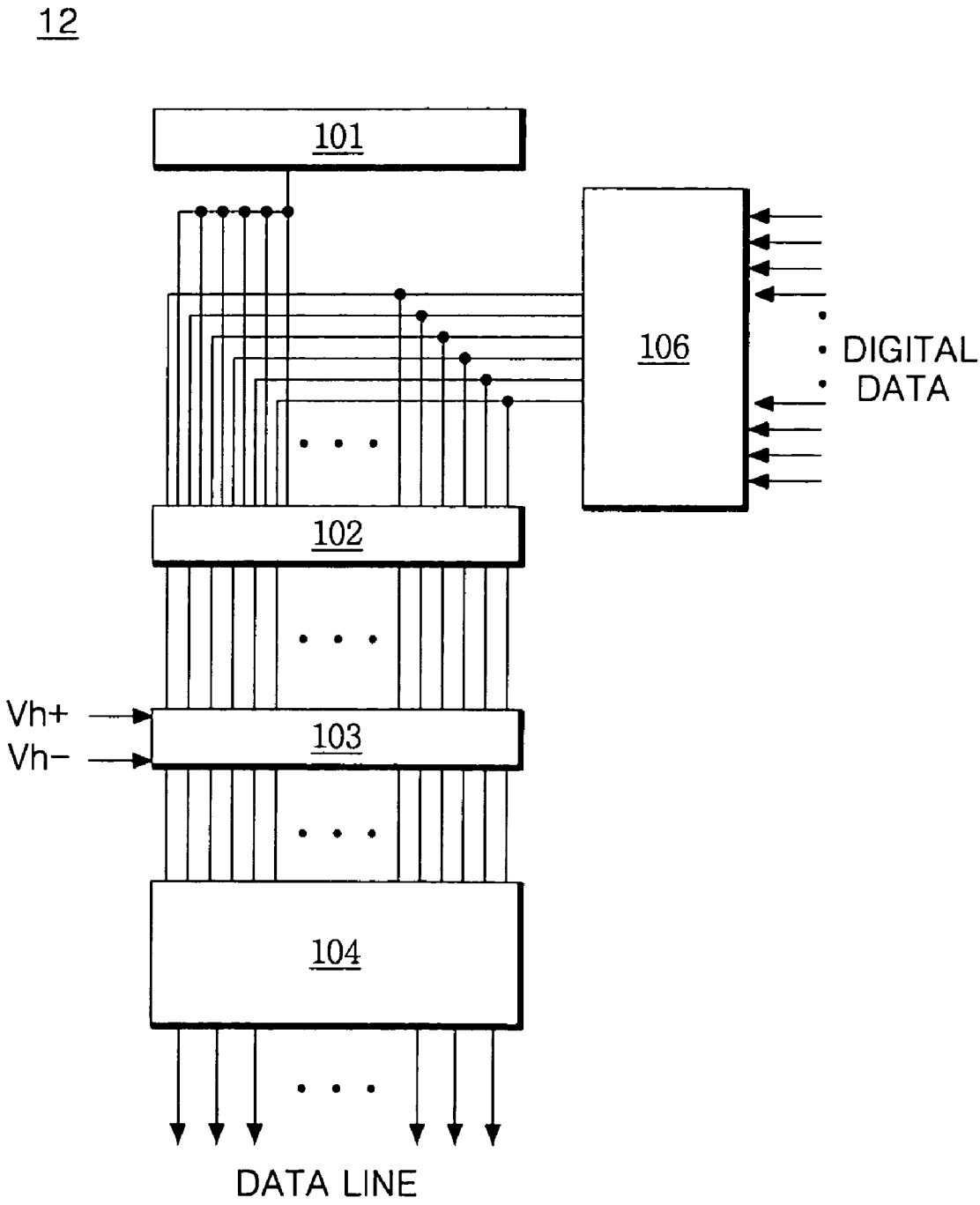
FIG. 10 is a diagram showing in detail the data driving circuit in FIG. 5.

FIG. 10 is a diagram showing in detail the data driving circuit 12.

Referring to FIG. 10, the data driving circuit 12 includes a plurality of data drive integrated circuits, and each integrated circuit includes a register 106 to which a digital data of one bit is inputted from the timing controller 11, a shift register 101 sequentially generating a sampling signal, a latch 102 subordinately connected between the register 106 and the data lines D1 to Dm, a Digital to Analog Converter (hereinafter, referred to as "DAC") 103, and an output buffer 104.

The register 106 temporarily stores a digital data of one bit which is inputted in serial from the timing controller 11, and supplies in parallel the digital data to the latch 102.

The shift register 101 shifts a source start pulse from the timing controller 11 in accordance with a source shift clock signal to generate a sampling signal. Furthermore, the shift register 101 shifts the source start pulse to transmit a carry signal to the adjacent integrated circuit.

The latch 102 sequentially samples and latches a digital data of one bit in accordance with a sampling signal, and then simultaneously supplies the latched a digital data of one bit to the DAC 103. In this case, the sampling signal is inputted from the shift register 101.

The DAC 103 converts a digital data of one bit from the latch 102 into a gamma compensation voltage, that is, the high potential data voltage Vh+ and the low potential data voltage Vh−.

The output buffer 104 supplies the data voltage Vdata to the data lines D1 to Dm without a loss. In this case, the data voltage Vdata is outputted from the DAC 103.

As described above, the electrophoresis display and the driving method thereof according to the present invention inverse a potential and a polarity of the common voltage by a frame period unit to boost an effective voltage. Herein, the effective voltage is defined by a difference between the data voltage and the common voltage. As a result, the data voltage can be reduced. Furthermore, the present invention boosts the effective voltage to speed up a particle movement within the micro capsule. As a result, time which is spent at a data update, can be reduced. Since only high potential voltage and low potential voltage are generated as the data voltage, the present invention can reduce a digital data corresponding to the data voltages by one bit. As a result, the present invention can reduce a storage capacitance of a memory which is stored with digital data. Furthermore, the present invention steps down the data voltage to decrease a size of the data drive integrated circuit and to reduce a cost of the circuit.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An electrophoresis display, comprising:

an electrophoresis display panel having a plurality of data lines and a plurality of gate lines that cross each other, a plurality of micro capsules and a plurality of cells which are driven in accordance with a voltage applied to a pixel electrode and a common electrode;

a data driving circuit converting digital data into a data voltage to supply the data voltage to the data lines;

a gate driver circuit supplying a scan pulse to the gate lines;

a common voltage generation circuit supplying an AC common voltage to the common electrode with a polarity that is inverted each frame period for at least two frame periods; and a timing controller controlling the data driving circuit, the gate driving circuit, and the common voltage generation circuit, and supplying the digital data to the data driving circuit, wherein each of the micro capsules is divided into a reset period, a first stabilization period, a second stabilization and a data writing period in accordance with the data voltage and the AC common voltage, wherein the polarity of the AC common voltage is inverted at least for the reset period and data writing period to boost an effective voltage for driving, the effective voltage is defined by a difference between the data voltage and the common voltage.

2. The electrophoresis display as claimed in claim 1, wherein each of the micro capsules includes positively charged white particles and negatively charged black particles that are driven by the effective voltage.

3. The electrophoresis display as claimed in claim 1, wherein the timing controller includes:

a memory storing a current frame image and a next frame image; and a look-up table comparing cells of the current frame image with the cells of the next frame image and that outputs one bit of digital data and one bit of a common voltage control data that controls the drive waveform of the predetermined AC drive voltage.

4. The electrophoresis display as claimed in claim 3, wherein the drive waveform of the data voltage includes:

a reset voltage waveform which is generated for the reset period inclusive of a plurality of frame periods to initialize the micro capsule;

a first stabilization voltage waveform for separating the electrically charged particles within the micro capsule for the first stabilization period inclusive of a plurality of frame periods following the reset period;

a second stabilization voltage waveform for separating the electrically charged particles within the micro capsule in a direction opposite to the first stabilization period for the second stabilization period inclusive of a plurality of frame periods, following the first stabilization period; and an entry data voltage waveform for expressing a gray level in the cell for the data writing period inclusive of a plurality of frame periods, following the second stabilization period.

5. The electrophoresis display as claimed in claim 4, wherein a polarity of the AC common voltage is inversed by one each frame period unit for the reset period, the first stabilization period, the second stabilization period, and the data writing period.

6. The electrophoresis display as claimed in claim 5, wherein the entry data voltage waveform is generated in the same phase as a phase of the AC common voltage during the data writing period.

7. The electrophoresis display as claimed in claim 4, wherein the AC common voltage is maintained as a high potential voltage for the first stabilization period and is maintained as a low potential voltage for the second stabilization period.

8. The electrophoresis display as claimed in claim 1, wherein the data voltage is generated in a low potential voltage for the first stabilization period, and is generated in a high potential voltage for the second stabilization period.

9. The electrophoresis display as claimed in claim 1, wherein each of the micro capsules includes negatively charged white particles and positively charged black particles which can be driven by the effective voltage.

10. A method of driving an electrophoresis display, including an electrophoresis display panel having a plurality of data lines and a plurality of gate lines that cross each other, and a plurality of cells which are driven in accordance with a voltage applied to a pixel electrode and a common electrode, the method comprising:

converting digital data into a data voltage to supply the data voltage to the data line;

supplying a scanning pulse to the gate line; and supplying an AC common voltage to the common electrode with a polarity that is inverted each frame period for at least two frame periods, wherein the each of the cells includes a micro capsule, wherein each of the micro capsules is divided into a reset period, a first stabilization period, a second stabilization and a data writing period in accordance with the data voltage and the AC common voltage, wherein the polarity of the AC common voltage is inverted at least for the reset period and data writing period to boost an effective voltage for driving, the effective voltage is defined by a difference between the data voltage and the common voltage.

11. The method of driving the electrophoresis display as claimed in claim 10, wherein each of the micro capsules includes positively charged white particles and negatively charged black particles which can be driven by the effective voltage.

12. The method of driving the electrophoresis display as claimed in claim 10, further comprising:

comparing a current frame image with a next frame image cell by cell and outputting one bit of digital data corresponding to the drive waveform of the data voltage in accordance with a comparison result thereof; and outputting one bit of a common voltage control data that controls the drive waveform of the AC drive voltage, wherein a polarity of the AC common voltage is inverted in accordance with the common voltage control data.

13. The method of driving the electrophoresis display as claimed in claim 12, wherein the drive waveform of the data voltage includes:

a reset voltage waveform which is generated for the reset period inclusive of a plurality of frame periods to initialize the micro capsule;

a first stabilization voltage waveform for separating the electrically charged particles within the micro capsule for the first stabilization period inclusive of a plurality of frame periods, following the reset period;

a second stabilization voltage waveform for separating the electrically charged particles within the micro capsule in a direction opposite the first stabilization period for the second stabilization period inclusive a plurality of frame periods, following the first stabilization period; and an entry data voltage waveform for expressing a gray level in the cell for the data writing period inclusive of a plurality of frame periods, following the second stabilization period.

14. The method of driving the electrophoresis display as claimed in claim 13, wherein a polarity of the AC common voltage is inversed by the one frame period unit for the reset period, the first stabilization period, the second stabilization period, and the data writing period.

15. The method of driving the electrophoresis display as claimed in claim 14, wherein the entry data voltage waveform is generated in the same phase as a phase of the AC common voltage during the data writing period.

16. The method of driving the electrophoresis display as claimed in claim 13, wherein the AC common voltage is maintained as a high potential voltage for the first stabilization period and is maintained as a low potential voltage during the second stabilization period.

17. The method of driving the electrophoresis display as claimed in claim 13, wherein the data voltage is generated in a low potential voltage for the first stabilization period and is generated in a high potential voltage for the second stabilization period.

18. The method of driving the electrophoresis display as claimed in claim 10, wherein each of the micro capsules includes negatively charged white particles and positively charged black particles which can be driven by the effective voltage.

19. A method of driving an electrophoresis display, including an electrophoresis display panel having a plurality of data lines and a plurality of gate lines crossing each other, and a plurality of cells which are driven in accordance with a voltage applied to a pixel electrode and a common electrode, the method comprising:

supplying a data voltage to the pixel electrode and supplying a common voltage having a potential difference with the data voltage to the common electrode to change an arranged state of charged particles within the cells; and supplying a data voltage with a voltage that is periodically changed to the pixel electrode and supplying a common voltage with a voltage that has the same phase as the waveform of the data voltage to the common electrode to maintain an arranged state of the charged particles within the cells, wherein each of the cells having a micro capsule is divided into a reset period, a first stabilization period, a second stabilization and a data writing period in accordance with the data voltage and the common voltage, wherein the polarity of the common voltage is inverted at least for the reset period and data writing period to boost an effective voltage for driving, the effective voltage is defined by a difference between the data voltage and the common voltage.

20. The method of driving the electrophoresis display as claimed in claim 19, wherein the common voltage is changed by one frame period for the other periods except for a stabilization period which stabilizes charged particles to a bistable state within the cells.

* * * * *